US006346032B1

(12) United States Patent
Zhang et al.

(10) Patent No.: US 6,346,032 B1
(45) Date of Patent: Feb. 12, 2002

(54) FLUID DISPENSING FIXED ABRASIVE POLISHING PAD

(75) Inventors: Liming Zhang, Sunnyvale, CA (US); Andrew Black; Landon Vines, both of San Antonio, TX (US)

(73) Assignee: VLSI Technology, Inc., San Jose, CA (US)

( * ) Notice: Subject to any disclaimer, the term of this patent is extended or adjusted under 35 U.S.C. 154(b) by 0 days.

(21) Appl. No.: 09/410,186

(22) Filed: Sep. 30, 1999

(51) Int. Cl.[7] ..... B24B 1/00
(52) U.S. Cl. ..... 451/41; 451/285; 451/287
(58) Field of Search ..... 451/41, 285, 287, 451/288, 446; 134/102.2

(56) References Cited

U.S. PATENT DOCUMENTS

| | | | | | |
|---|---|---|---|---|---|
| 1,890,401 | A | * | 12/1932 | Mitchell | 451/551 |
| 5,246,525 | A | | 9/1993 | Sato | 156/345 |
| 5,329,734 | A | * | 7/1994 | Yu | 451/526 |
| 5,658,185 | A | | 8/1997 | Morgan, III et al. | 451/36 |
| 5,762,537 | A | * | 6/1998 | Sandhu et al. | 451/53 |
| 5,795,218 | A | * | 8/1998 | Doan et al. | 451/526 |
| 5,800,626 | A | * | 9/1998 | Cohen et al. | 134/102.2 |
| 5,816,900 | A | | 10/1998 | Nagahara et al. | 451/285 |
| 5,853,317 | A | * | 12/1998 | Yamamoto | 451/288 |
| 5,885,134 | A | * | 12/1998 | Shiba et al. | 451/41 |
| 5,887,605 | A | * | 3/1999 | Lee et al. | 134/102.2 |
| 5,931,724 | A | | 8/1999 | Perlov et al. | 451/285 |

FOREIGN PATENT DOCUMENTS

EP 0239040 A1 9/1987 ..... B24D/3/32

OTHER PUBLICATIONS

Patent Abstracts of Japan vol.1998, No. 10, Aug. 31, 1998 & JP 10 118921 A (Toshiba Ceramics Co Ltd), May 12, 1998 abstract; figure 1.

* cited by examiner

*Primary Examiner*—Joseph J. Hail, III
*Assistant Examiner*—Lee Wilson
(74) *Attorney, Agent, or Firm*—Wagner Murabito & Hao LLP

(57) ABSTRACT

The present invention is a fluid dispensing fixed abrasive polishing pad CMP system and method that utilizes fixed abrasive components to remove a portion or entire layer of a wafer while dispensing a fluid without suspended abrasive particles onto the wafer surface. A fluid dispensing fixed abrasive polishing pad is pressed against a wafer surface while rotating and fixed abrasive component apply a frictional force that planarizes a wafer surface. The fluid dispensed by the fluid dispensing fixed abrasive polishing pad assist the fixed components achieve wafer planarization in numerous ways, including minimizing scratching of the wafer surface, chemically reacting with the wafer surface to soften it, and aiding in the removal of particulate contaminants. The fluid flow in the present invention is strong enough to remove the waste (e.g., reaction products, wafer shavings, particulate contaminants, etc.) from the surface of the wafer and the fixed abrasive polishing pad during the polishing process. In one embodiment of the present invention, waste particles become suspended in the fluid and are sucked back through fluid dispensing ducts of the fluid dispensing fixed abrasive polishing pad.

3 Claims, 8 Drawing Sheets

100A

FLUID DISPENSING FIXED ABRASIVE POLISHING PAD

FIELD OF THE INVENTION

The field of the present invention pertains to semiconductor fabrication processing. More particularly, the present invention relates to a device for more efficiently polishing and planarizing a semiconductor wafer.

BACKGROUND OF THE INVENTION

Electronic systems and circuits have made a significant contribution towards the advancement of modem society and are utilized in a number of applications to achieve advantageous results. Numerous electronic technologies such as digital computers, calculators, audio devices, video equipment, and telephone systems include processors that have facilitated increased productivity and reduced costs in analyzing and communicating data, ideas and trends in most areas of business, science, education and entertainment. Frequently, electronic systems designed to provide these results include integrated circuits (ICs) on chip wafers. Usually, the wafers are produced by processes that include a polishing step to create a smooth wafer surface. Performing the polishing step in an effective and efficient manner is critical to IC wafer manufacturing.

The starting material for typical ICs is very high purity silicon. The pure silicon material is grown as a single crystal that takes the shape of a solid cylinder. This crystal is then sawed (like a loaf of bread) to produce wafers upon which electronic components are then constructed by adding multiple layers to the wafer through a process of lithography (e.g., photolithography, X-ray lithography, etc.). Typically, lithography is utilized to form electronic components comprising regions of different electrical characteristics added to the wafer layers. Complex ICs can often have many different built up layers, with each layer being stacked on top of the previous layer and comprising multiple components with a variety of interconnections. The resulting surface topography of these complex IC's are bumpy (e.g., they often resemble rough terrestrial "mountain ranges" with many rises or "hills" and dips or "valleys") after the IC components are built up in layers.

Lithographic techniques are usually able to reproduce very fine surface geometries and greater advantages and usefulness are realized in applications in which more components (e.g., resistors, diodes, transistors, etc.) are integrated into an underlying chip or IC. The primary manner of incorporating more components in a chip is to make each component smaller. In a photolithographic process, limitations on the depth of focus impact the projection of increasingly finer images onto the surface of the photosensitive layer. Depth of focus problems are exacerbated by rough topographies (e.g., the bumpy rises and dips causes by layers produced during lithographic processes). The "bumpy" topography of complex ICs exaggerate the effects of narrowing limits on the depth of focus which in turn limits the number of components that are incorporated on a chip. Thus, in order to focus desirable mask images defining sub-micron geometries onto each of the intermediate photosensitive layers in a manner that achieves the greatest number of components on a single wafer, a precisely flat surface is desired. The precisely flat or fully planarized surface facilitates extremely small depths of focus operations, and in turn, facilitates the definition and subsequent fabrication of extremely small components.

Polishing is the preferred method of obtaining full planarization of a wafer layer. It usually involves removing a sacrificial portion of material by rubbing a polishing pad on the surface of the wafer. Polishing flattens out height differences on the surface of the wafer, since high areas of topography (hills) are removed faster than areas of low topography (valleys). Most polishing techniques have the rare capability of smoothing out topography over millimeter scale planarization distances leading to maximum angles of much less than one degree after polishing.

One of the most common polishing techniques includes chemical mechanical polishing (CMP) processes that utilize an abrasive slurry dispensed on a polishing pad to aid in the smooth and predictable planarization of a wafer. The planarizing attributes of the slurry are typically comprised of an abrasive frictional component and a chemical reaction component. The abrasive frictional component is due to abrasive particles suspended in the slurry. The abrasive particles add to the abrasive characteristics of the polishing pad as it exerts frictional contact with the surface of the wafer. The chemical reaction component is attributable to polishing agents which chemically interact with the material of the wafer layer. The polishing agents soften or dissolve the surface of the wafer layer to be polished by chemically reacting with it. Together the abrasive frictional component and a chemical reaction component assist a polishing pad to remove material from the surface of the wafer.

The manner in which the slurry is distributed to the polishing pad significantly impacts the effectiveness of the abrasive and chemical characteristics of the slurry in aiding the polishing, which in turn impacts the removal rates. The traditional slurry distribution method is to dispense the slurry onto the top of a polishing pad, and the polishing pad transports it to the wafer surface. A polishing pad material usually has a roughened surface comprising a number of very small pits and gouges manufactured into the surface of the polishing pad. The pits and grooves of the roughened surface act as pockets that collect slurry for transportation to and from the wafer surface being polished. While abrasive slurries utilized in typical chemical mechanical polishing processes offer certain benefits, they can also result in detrimental side affects.

The free floating abrasive particles in typical abrasive slurries often pose certain problems. One problem with typical abrasive CMP slurries is uneven polishing as a result of insufficient dispersion stability in most slurries. It is important to evenly distribute the slurry over the surface of the pad and wafer so that the removal of the wafer layer is even. Solid abrasion particles in most slurries tend to settle down and/or aggregate in the slurry solution. If a portion of the wafer is exposed to contact with an excessive amount of slurry it usually is removed at a faster rate and portions that are not exposed to enough slurry are usually removed at a slower rate, creating a rough topography instead of a planarized one. Thus, it is preferable to avoid detrimental uneven layer removal due to agglomeration of the slurry particles and/or non-uniform distribution.

Traditional slurry distribution systems typically do not provide a uniform distribution of slurry across a wafer surface. For example, most slurry distribution systems apply fresh slurry to the edge of a wafer and then transport it to the center of the wafer. However, by the time the slurry reaches the center of the wafer some of the abrasive characteristics of the slurry are spent. Thus fresh slurry applies more abrasive friction to the edge of the wafer removing material relatively fast and spent slurry applies less abrasive force to the center of the wafer removing material relatively slower resulting in an unevenly polished wafer surface.

As abrasive slurry is consumed during the polishing process waste particles comprising spent abrasive particles and waste "shaved" from the wafer are produced. Particulate contamination associated with spent abrasive particles can have very detrimental impacts and is a great concern with respect to the surface cleanliness after CMP. Spent abrasive particles usually cannot be readily dissolved by chemical interaction. Free spent abrasive particles in the slurry tend to increase the probability that the "waste" particles will deposit on the wafer surface. In addition, the residue of spent abrasive particles tends to lodge in the grooves and pits of the polishing pad that are otherwise intended to assist in carrying fresh slurry to the surface of the wafer. In order to maintain the efficient delivery of fresh slurry by the polishing pad, frequent pad conditioning is required because the pits and grooves intended to carry fresh are filled up with spent abrasive slurry particles. The most common method of pad conditioning is to remove a layer of the polishing pad surface and re-texture it with new pits and grooves. Frequent conditioning of a polishing pad typically delays the polishing process and increases the rate at which polishing pads wear out.

It is desirable to have a polishing pad that does not require abrasive assistance from slurry. A typical slurry free polishing pad has a surface with abrasive characteristics such as fixed abrasive components or particles that remove a portion of top wafer layer. Although fixed abrasive polishing pads relieve abrasive slurry concerns, particulate contamination is still an issue because of limited liquid flow that is not strong enough to remove waste products from the surface of the wafer and polishing pad during the CMP processes. In addition, scratching is also an issue because the abrasive material is no longer mobile, as in a flowing slurry system and conditioning of fixed abrasive polishing pads is not easy.

What is required is a system and method that facilitates an efficient and effective manner to polish the surface of an IC wafer. The system and method should not require free floating abrasive particles nor result in undue particle contamination on the wafer surface. It should also aid conditioning processes to prepare a pad for continued use. The system and method should facilitate defect reduction (e.g., lower defect density) and cleaner CMP processes that improve reliability of integrated circuit manufacturing.

SUMMARY OF THE INVENTION

The present invention includes a fluid dispensing fixed abrasive polishing pad device and method for efficiently polishing an IC wafer. The fluid dispensing fixed abrasive polishing pad device and method of the present invention assists a CMP process to achieve efficient wafer planarization by utilizing a fixed abrasive polishing pad with fluid provided via holes in the fixed abrasive polishing pad. The present invention is able to achieve consistent removal rate and a smooth polished wafer surface without suffering from detrimental side affects caused by abrasive slurry particles. For example, uneven layer removal due to agglomeration of the abrasive slurry particles, abrasive slurry particulate contamination deposited on the wafer surface, spent abrasive particles lodging in the grooves and pits of the polishing pad that are otherwise intended to assist in carrying fresh slurry to the surface of the wafer.

In one embodiment of the present invention, a fluid dispensing fixed abrasive polishing pad comprises a polishing pad body with fixed abrasive components and fluid dispensing ducts. The fixed abrasive component removes a portion or entire wafer layer when rubbed against the surface of the wafer without the assistance of abrasive particles suspended in a slurry, and therefore does not suffer detrimental side affects associated with abrasive slurries . The fluid dispensing duct permits fluid to flow from a surface of fluid dispensing fixed abrasive polishing pad to the wafer. The fluid dispensing fixed abrasive polishing pad is capable of dispensing a variety of fluids, including fluids comprising chemicals that assist with the polishing process and/or waste particle removal. In addition, the flow of fluid in the present invention is strong enough to remove the waste (e.g., reaction products, wafer shavings, particulate contaminants, etc.) from the surface of the wafer and the fixed abrasive polishing pad during the polishing process. In one embodiment of the fluid dispensing fixed abrasive polishing pad waste particles are sucked or vacuumed back through the fluid dispensing duct.

DETAILED DESCRIPTION

Reference will now be made in detail to the preferred embodiments of the invention, a fluid dispensing fixed abrasive polishing pad method and system, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one ordinarily skilled in the art that the present invention may be practiced without these specific details. In other instances, well known methods, procedures, components, and circuits have not been described in detail as not to unnecessarily obscure aspects of the current invention.

The present invention is a CMP system and method that utilizes fixed abrasives components on a polishing pad to planarize a wafer surface with assistance of fluid distributed by the polishing pad. As the polishing progresses, the system and method of the present invention dispenses fluid through access ducts in the polishing pad to facilitate efficient removal of a portion or entire layer of a wafer surface along with the resulting waste particles that are generated during polishing. The present system and method uses polishing pads comprising fixed abrasives and does not rely on abrasive slurry particles, thereby avoiding the detrimental side affects resulting from abrasive slurry particles. The fluid dispensing fixed abrasive polishing pad features of the present invention system and method permit reduced manufacturing times and slurry consumption during IC wafer fabrication.

Figure 1A:
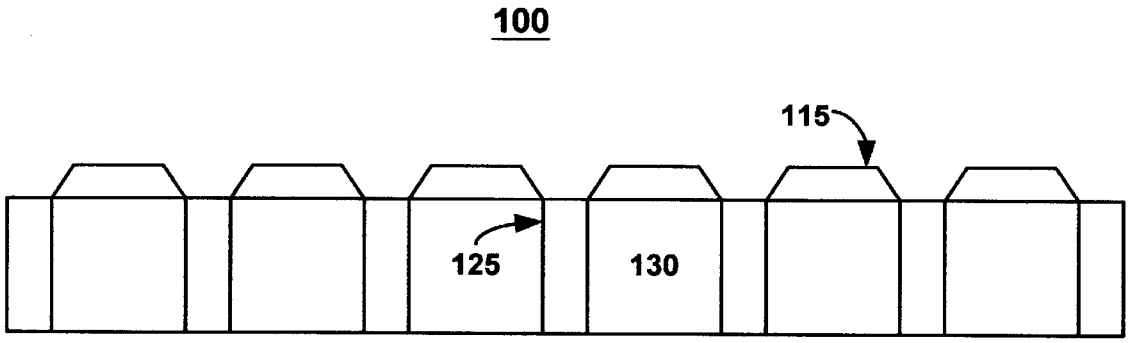
FIG. 1A is a side view showing schematics of a fluid dispensing fixed abrasive polishing pad, one embodiment of the present invention.
Figure 1B:
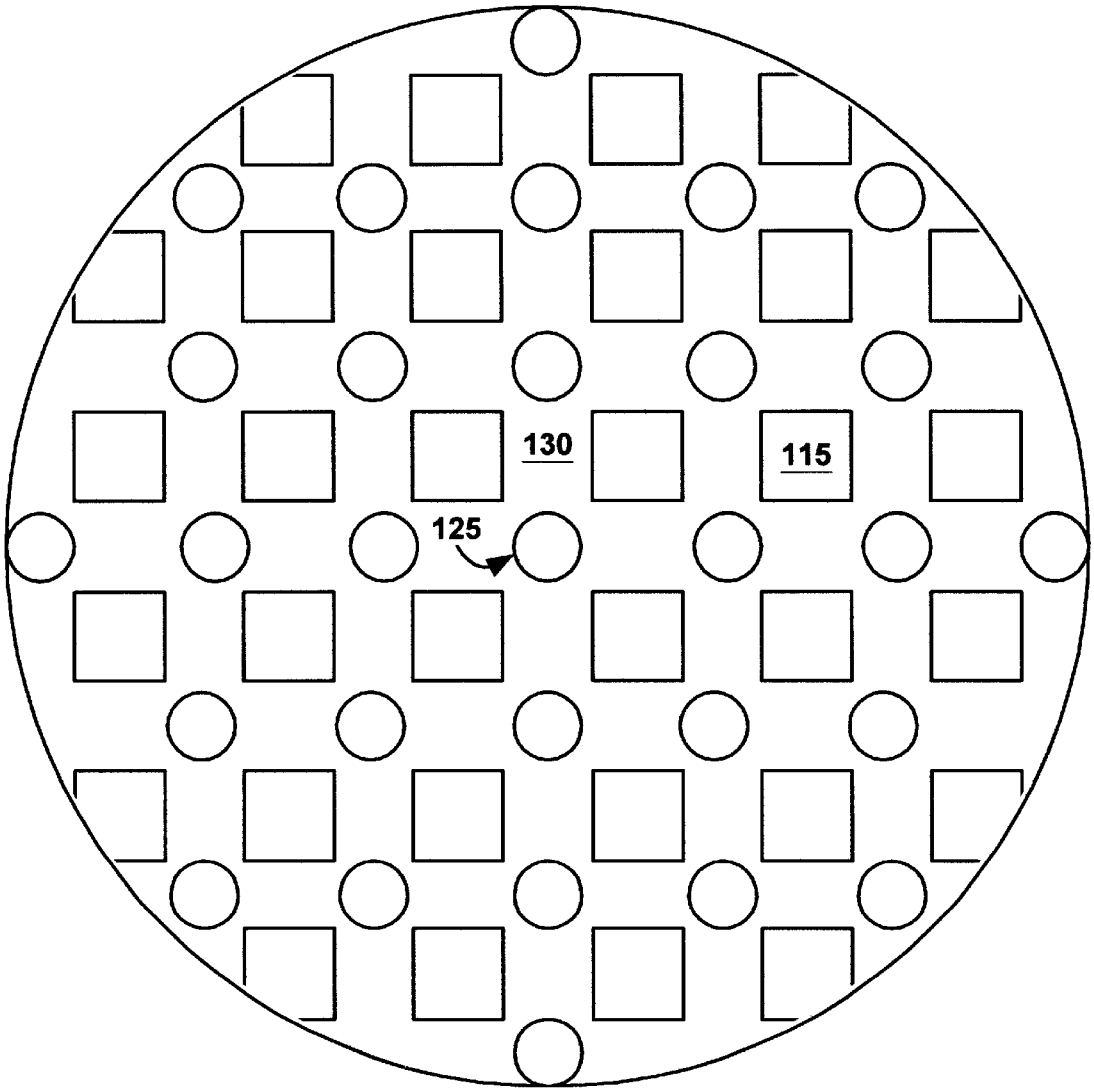
FIG. 1B is a down view showing schematics of one embodiment of a fluid dispensing fixed abrasive polishing pad of the present invention.

FIG. 1A is a side view and FIG. 1B is a down view showing schematics of fluid dispensing fixed abrasive polishing pad 100, one embodiment of the present invention. Fluid transport fixed abrasive polishing pad 100 comprises a polishing pad body 130, fixed abrasive components (e.g., fixed abrasive component 115) and fluid dispensing ducts (e.g., fluid dispensing duct 125). Polishing pad body 130 is coupled to fixed abrasive component 115 and fluid dispensing duct 125. Polishing pad body 130 has a diameter and a lower surface substantially parallel to a plane defined by a diameter and an outer radius surface substantially orthogonal to the plane defined by the diameter. An upper surface is located opposite the lower surface. Fixed abrasive component 115 is adapted to remove a portion of wafer when rubbed against the surface of the wafer. Fluid dispensing duct 125 extends through the fluid dispensing fixed abrasive polishing pad from the lower surface to the upper surface, wherein the fluid dispensing duct 125 is adapted to permit fluid to flow from a surface of fluid dispensing fixed abrasive polishing pad 100 to the wafer. Fluid dispensing fixed abrasive polishing pad 100 efficiently polishes a wafer in an effective manner.

The fixed abrasive components of fluid dispensing fixed abrasive polishing pad 100 provides sufficient abrasive action when rubbed against the surface of the wafer to remove a portion of entire layer of the wafer. In one embodiment of fluid dispensing fixed abrasive polishing pad 100, the fixed abrasive component comprises abrasive particles coupled to the surface of the polishing pad and in another embodiment the abrasive particles are also contained uniformly distributed throughout the volume of the polishing pad body. The fixed abrasive components (e.g., fixed abrasive component 125) are uniformly and densely distributed over the surface of fluid dispensing fixed abrasive polishing pad 100. In some embodiments of fluid dispensing fixed abrasive polishing pad 100, there are numerous fixed abrasive components or particles between each fluid dispensing duct. The fixed abrasive components of fluid dispensing fixed abrasive polishing pad 100 do not require assistance from abrasive particles in an abrasive slurry and therefore systems and methods utilizing fixed abrasive polishing pad 100 do not suffer detrimental side affects associated with abrasive slurries (e.g., uneven polishing due to agglomeration or build up of spent abrasive slurry particles on the pad).

The present invention is capable of dispensing a variety of fluids and is adaptable to numerous situations. In one embodiment of the present invention, a fluid dispensing fixed abrasive polishing pad dispenses water and in another embodiment it dispenses solutions comprising certain chemicals that interact with the wafer with assistance from the fixed abrasive components. For example, a fluid comprising a chemical (e.g., base or acid) is gradually introduced to the surface of the fluid dispensing fixed abrasive polishing pad. In another example, a high pH liquid (e.g., NH4OH) flows to the surface of fluid dispensing fixed abrasive polishing pad and electrostatically prevents particulate from bonding to the wafer surface and forming defects. Furthermore, the present invention permits continuous alteration of the chemical composition of the fluid in addition to simple on-off control of certain fluids to the surface of the fluid dispensing fixed abrasive polishing pad. This avoids the time consuming and wasteful process of washing away an "older" solution comprising one chemical composition and adding a "newer" solution comprising a different chemical composition (e.g., a copper -CMP embodiment with more than one step and one chemistry).

The fluid dispensed though the ducts of fluid dispensing fixed abrasive polishing pad 100 (e.g., fluid dispensing duct 125) assist the fixed components achieve wafer planarization in numerous ways. The liquid flow in the present invention is adjusted to minimize the scratching of the wafer surface by the fixed abrasive components. As discussed above, in one embodiment the fluid chemically reacts with the wafer surface to soften it, thereby making planarization of the wafer by the fixed abrasive components of fixed abrasive polishing pad 100 easier. Dispensing the fluid through the pad directly onto the surface of the wafer permits the fluid to interact with the wafer very effectively and uniformly. In addition, the fluid does not consist of abrasive slurry particles and avoids clogging of polishing pad fluid dispensing ducts with abrasive slurry particles. Furthermore, fluids dispensed though the ducts of fluid dispensing fixed abrasive polishing pad 100 aid in the removal of particulate contaminants.

Utilizing fluid to remove waste products from the surface of the wafer and the surface of fluid dispensing fixed abrasive polishing pad offers significant advantages over a fixed abrasive polishing pad alone. The fluid flow in the present invention is strong enough to remove the waste (e.g., reaction products, wafer shavings, particulate contaminants, etc.) from the surface of the wafer and the fixed abrasive polishing pad during the polishing process. Removing the waste permits the abrasive components of the fixed abrasive polishing pad to more efficiently contact and remove the wafer surface without interference from waste particles. In addition, removing the waste from the surface of the wafer decreases the probability of defects on the wafer surface caused by waste particles. Furthermore, pad conditioning is simpler with a fluid dispensing fixed abrasive polishing pad of the present invention because cleansing fluids are forced through the fluid dispensing ducts, forcing contaminant waste particles out of the fluid dispensing ducts and the space around the fixed abrasive components. Thus, pad reconditioning is not required as often since the dispensed fluid forces waste particles out of the pits and grooves.

There are numerous ways in which the fluid dispensing ducts of the present invention are utilized. In one example of the present invention, a fluid dispensing fixed abrasive polishing pad flushes the surface of the wafer and fluid dispensing fixed abrasive polishing pad both during and after the contaminant particles are flushed away. In one embodiment of the present invention, the fluid dispensing ducts are utilized to dispense fluid during certain intervals and collect polishing by-products at other desired intervals. For example, fluid is first dispensed onto the surface of a fluid dispensing fixed abrasive polishing pad, mixed with the waste particles, and then the fluid and waste particles are removed by vacuuming the waste particles through the fluid dispensing ducts. In one embodiment of the present invention, the removal of particles is achieved at the end of a polishing process by introducing a higher pH fluid or surfactant to assist in removing the particles by vacuuming the particles off the substrate through the fluid dispensing ducts.

Figure 1C:
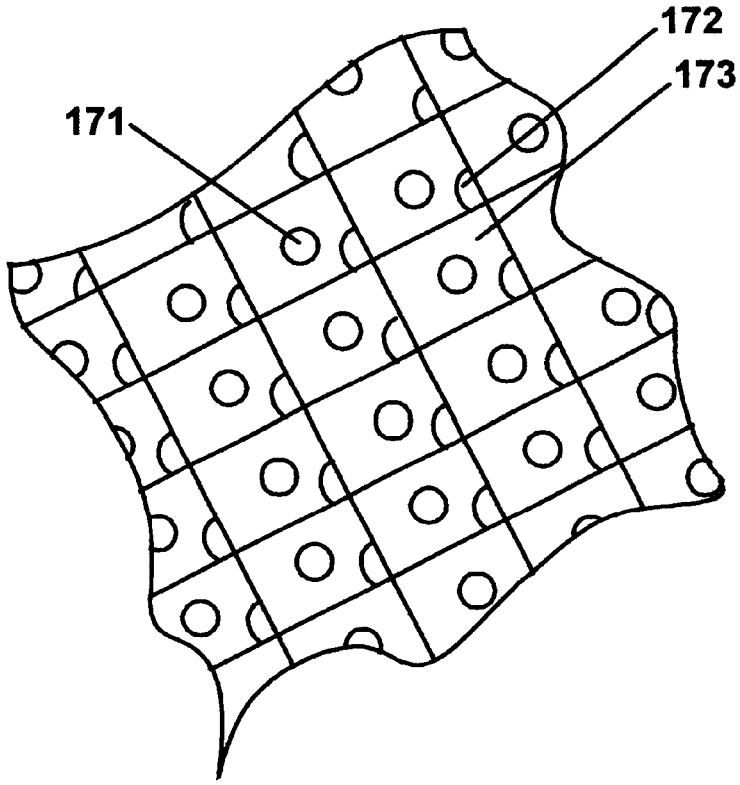
FIG. 1C shows one configuration of fluid dispensing ducts and abrasive components in one embodiment of the present invention.

It should be appreciated that there are numerous fluid dispensing fixed abrasive polishing pad configurations of the present invention. In one embodiment of the present invention the fluid is introduced through a fluid dispensing duct in the center of the platen and then use the ducts in the surface of the fluid dispensing fixed abrasive polishing pad to distribute the fluid. Different embodiments of a fluid dispensing fixed abrasive polishing pad of the present invention have configurations (e.g., arrangement of fluid dispensing ducts) that are arranged to meet specific needs of a particular situation. FIG. 1C show another configuration of fluid dispensing ducts and abrasive component in one embodiment of a fluid dispensing fixed abrasive polishing pad 100A of the present invention. Fluid dispensing fixed abrasive polishing pad 100A comprises a polishing pad body 173, fixed abrasive components (e.g., fixed abrasive component 172) and fluid dispensing ducts (e.g., fluid dispensing duct 171). In one embodiment of the present invention the width or diameter of the fluid dispensing ducts range from one micron to 200 microns and are made during the manufacturing of the fluid dispensing fixed abrasive polishing pad.

Figure 2A:
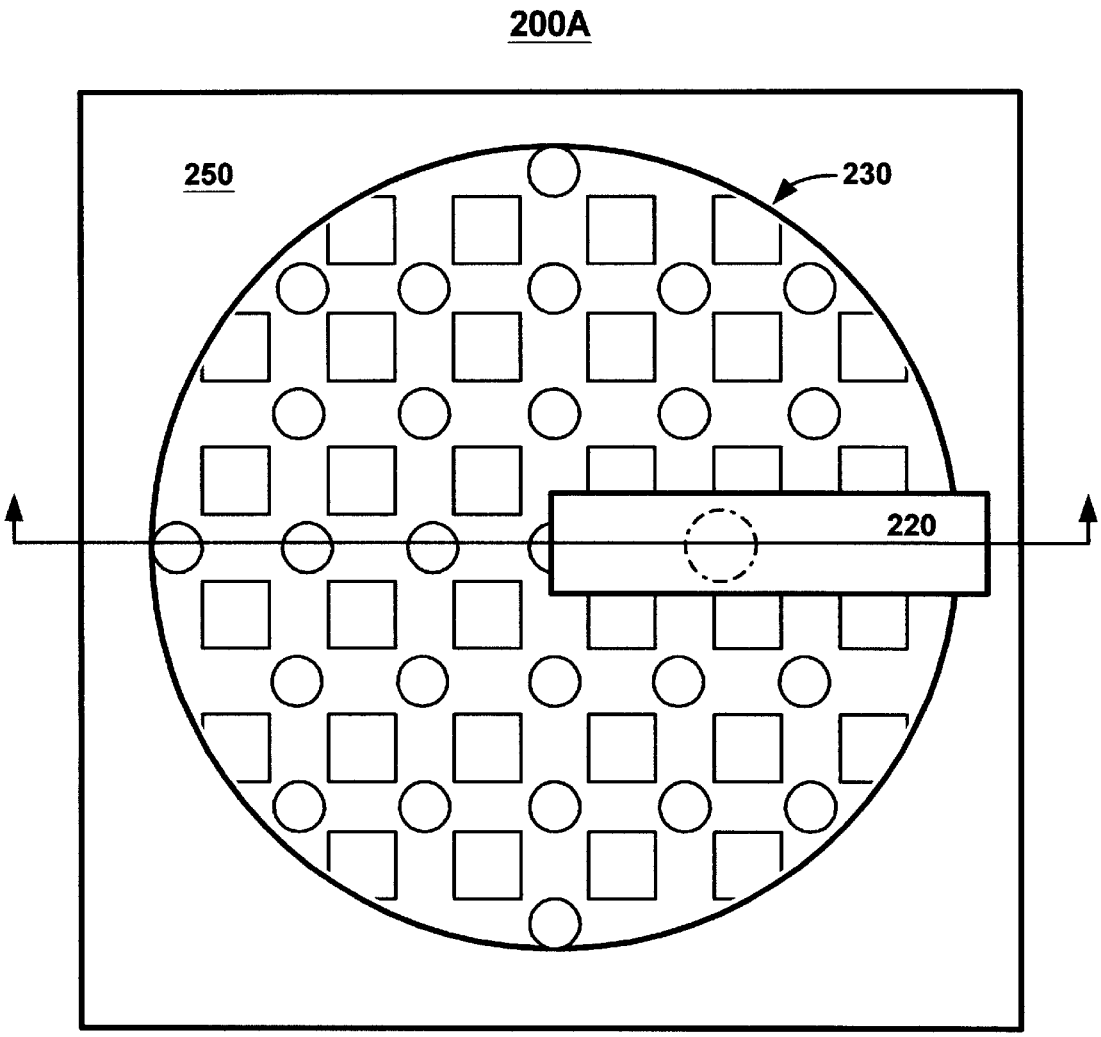
FIG. 2A is a down view of a fluid dispensing fixed abrasive polishing pad CMP system, one embodiment of the present invention.

FIG. 2A is a down view of a fluid dispensing fixed abrasive polishing pad CMP system 200A, one embodiment of the present invention. CMP system 200 comprises a wafer holder 220, fluid dispensing fixed abrasive polishing pad component 230, and CMP machine 250. CMP machine 250 is coupled to a wafer holder 220 and fluid dispensing fixed abrasive polishing pad component 230. The components of CMP system 200 cooperatively operate to planarize an IC wafer. Wafer holder 220 holds the IC wafer against fluid dispensing fixed abrasive polishing pad component 230. Fluid dispensing fixed abrasive polishing pad component 230 polishes and planarizes the IC wafer by applying a fluid and physical frictional force to the surface of the wafer. CMP machine 250 provides a interface to control fluid dispensing fixed abrasive polishing pad CMP system 200A.

Figure 2B:
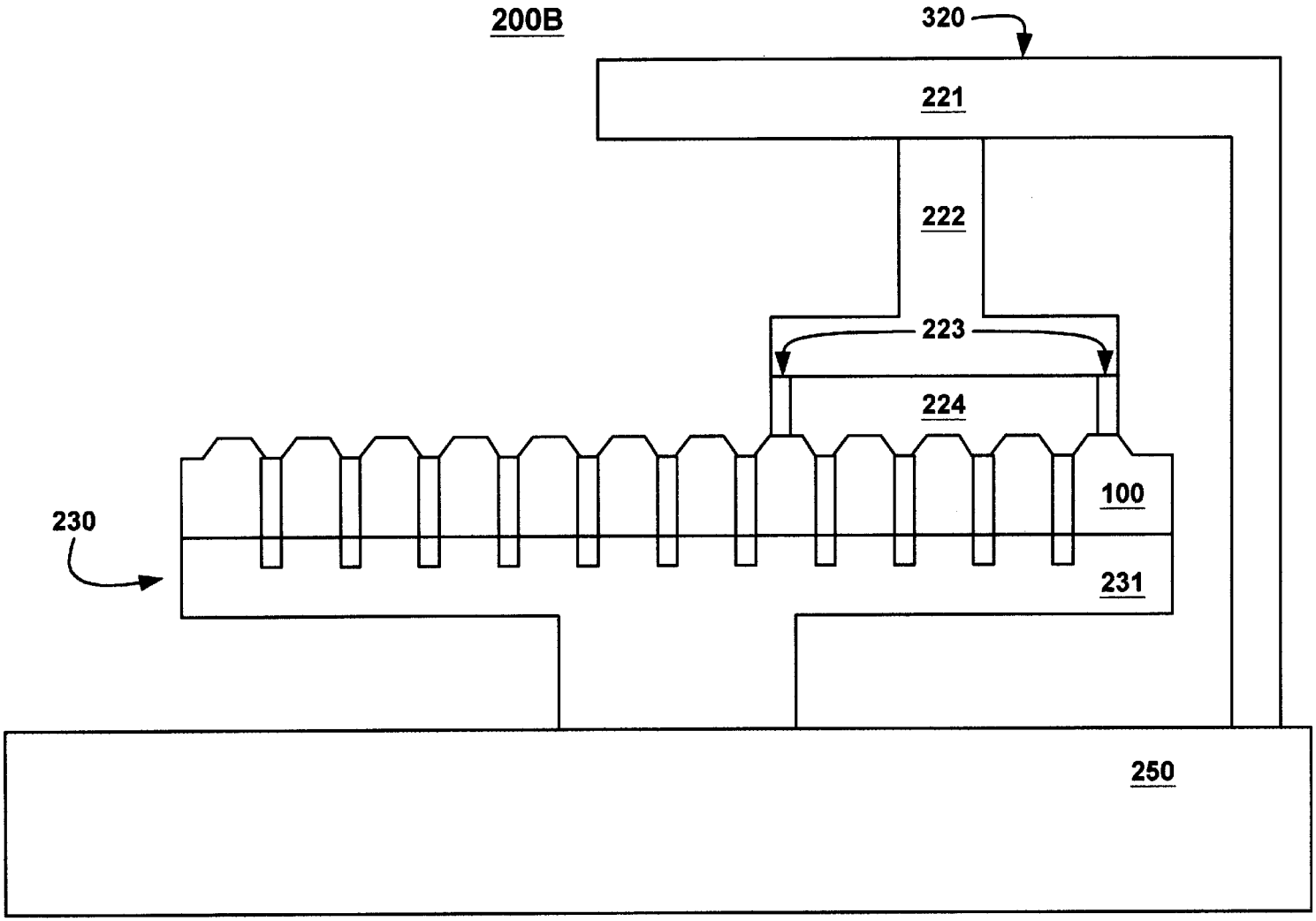
FIG. 2B shows a side view of one embodiment of a fluid dispensing fixed abrasive polishing pad CMP system in accordance with one embodiment of the present invention.

FIG. 2B shows a side view of fluid dispensing fixed abrasive polishing pad CMP system 200B, one embodiment of fluid dispensing fixed abrasive polishing pad CMP system 200A. Fluid dispensing fixed abrasive polishing pad CMP system 200B comprises wafer holder 220, fluid dispensing fixed abrasive polishing pad component 230, and CMP machine 250. CMP machine 250 is coupled to wafer holder 220 and fluid dispensing fixed abrasive polishing pad component 230. The components of fluid dispensing fixed abrasive polishing pad CMP system 200B cooperatively function to polish and planarize an integrated circuit (IC) wafer 224.

Fluid dispensing fixed abrasive polishing pad component 230 is utilized to transport a fluid to a wafer (e.g., wafer 224) and apply an abrasive frictional force to the surface of the wafer. Fluid dispensing fixed abrasive polishing pad component 230 comprises a fluid dispensing fixed abrasive polishing pad 100 and turn table platen 231. Fluid dispensing fixed abrasive polishing pad 100 is coupled to turn table platen 231. Fluid dispensing fixed abrasive polishing pad 100 is adapted to planarize a surface of the wafer. Turn table platen 231 is adapted to rotate fluid dispensing fixed abrasive polishing pad 100 at a predetermined speed and transmit fluid to the fluid dispensing ducts of fluid dispensing fixed abrasive polishing pad 100. In one embodiment of the present invention, fluid dispensing fixed abrasive polishing pad 100 is made of a resilient material comprising fixed abrasive particles and fluid dispensing ducts to aid the polishing process without the use of abrasive particles suspended in a slurry as described above.

Figure 2C:
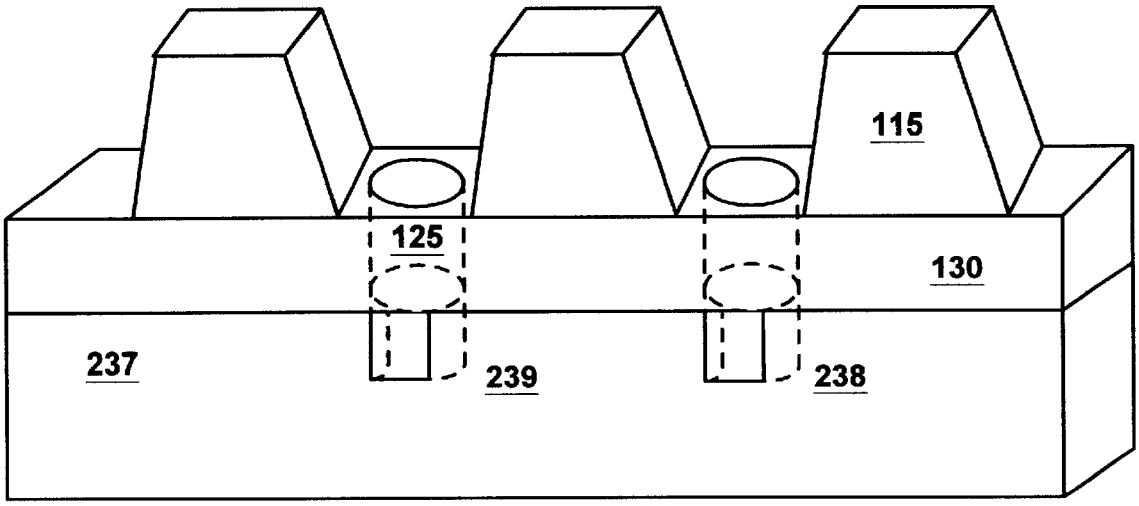
FIG. 2C is a cut out view showing a portion of one embodiment of the components of a fluid dispensing fixed abrasive polishing pad component of the present invention.
Figure 2D:
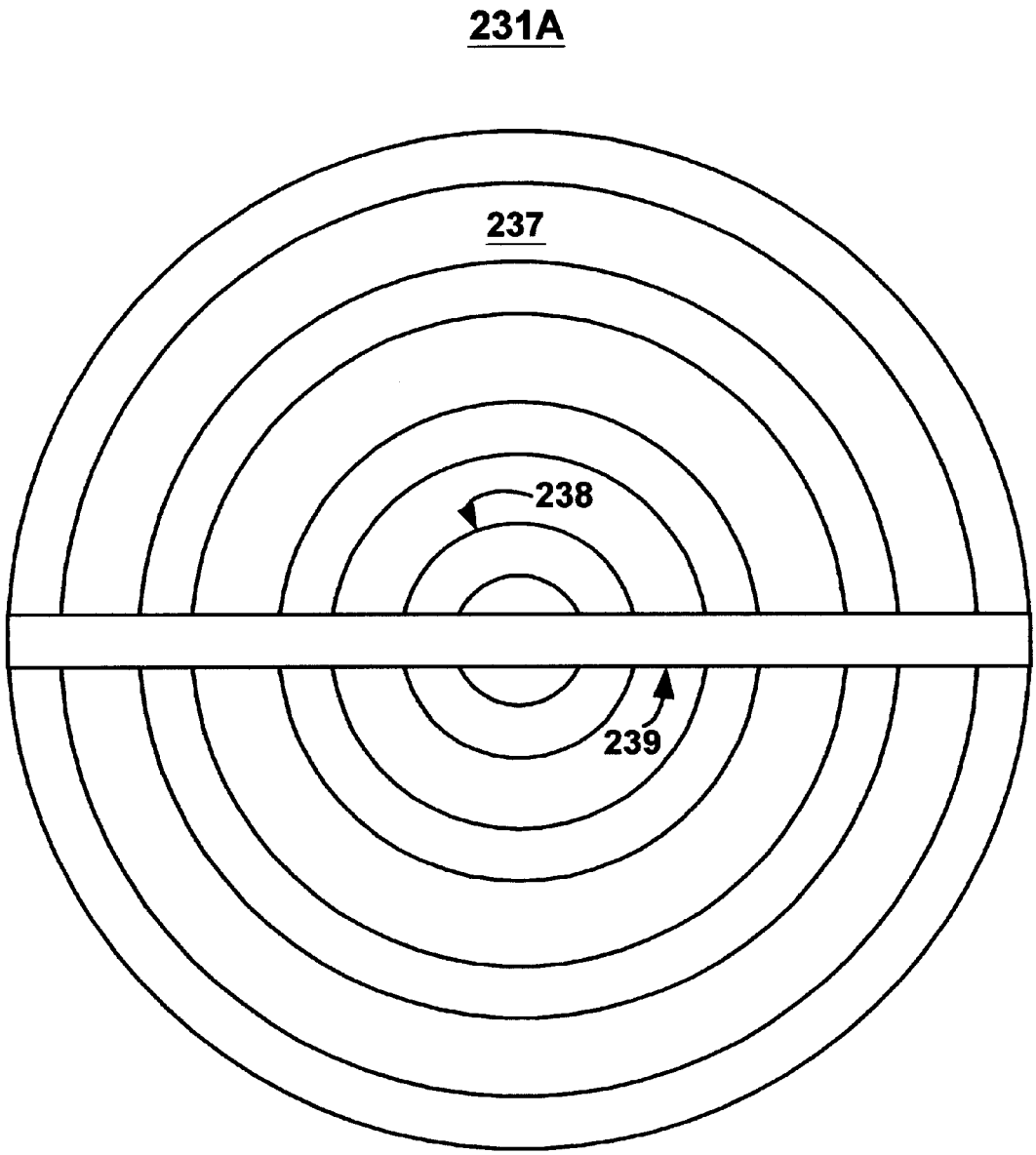
FIG. 2D is a top view diagram of one embodiment of a turn table platen of the present invention

FIG. 2C is a cut out view showing a portion of one embodiment of the components of fluid dispensing fixed abrasive polishing pad component 230A. FIG. 2D is a top view diagram of one embodiment of a turn table platen 231A. Turn table platen 231A comprises turn table platen body 237 and fluid dispensing duct trenches (e.g., fluid dispensing duct trench 238 or 239). The fluid dispensing duct trenches are adapted to transport fluid to the fluid dispensing ducts of fluid dispensing fixed abrasive polishing pad 100.

Wafer holder 220 picks up a wafer (e.g., wafer 224) and holds it in place on fluid dispensing fixed abrasive polishing pad 100. Wafer holder 220 comprises a holder arm 221, a carrier 222 and a carrier ring 223. Holder arm 221 is coupled to CMP machine 250 and carrier 222 which is coupled to carrier ring 223. The lower surface of the wafer 224 rests against fluid dispensing fixed abrasive polishing pad 100. The upper surface of the wafer 224 is held against the lower surface of the carrier 222. As fluid dispensing fixed abrasive polishing pad 100 rotates, carrier 222 also rotates wafer 224 at a predetermined rate while forcing the wafer onto fluid dispensing fixed abrasive polishing pad 100 with a predetermined amount of down force. The abrasion resulting from the frictional force caused by the rotating action of both the fluid dispensing fixed abrasive polishing pad 100 and the wafer 224 combine to Polish and planarize wafer 224.

One embodiment of fluid dispensing fixed abrasive polishing pad CMP system 200A includes a polishing pad conditioner that aids in maintaining abrasive characteristics of polishing pad. The polishing pad conditioner facilitates removal of worn out and or waste filled surface of a polishing pad and reconstruction of groves and pits in the surface of the polishing pad. A polishing pad with a continuously roughened surface produces a relatively faster and more constant removal rate. The fluid dispensing fixed abrasive polishing pad of the present invention aids the conditioning process. The fluid dispensing fixed abrasive polishing pad aids in keeping various particles (e.g., spent slurry particles, waste wafer particles, etc.) that accumulate on the surface of the polishing pad from clogging up the groves and pits in the surface of the polishing pad. In one embodiment of the present invention, the fluid from a fluid dispensing fixed abrasive polishing pad of the present invention forces sufficient waste particles out of pits and grooves in the surface of a polishing pad that a separate conditioner is not required to clean and condition the polishing pad.

CMP machine 250 operates as the primary interface and motor mechanism of fluid dispensing fixed abrasive CMP system 200B. In one embodiment of the present invention CMP machine 250 includes a motor that rotates polishing pad component 230. In one example of CMP system fluid dispensing fixed abrasive 200B, CMP machine 250 includes a computer system that controls CMP operations, such as the flow rate of the fluid, the downward force and rotational rate of carrier 222, the upward force and rotational rate of polishing pad component 230.

Figure 3:
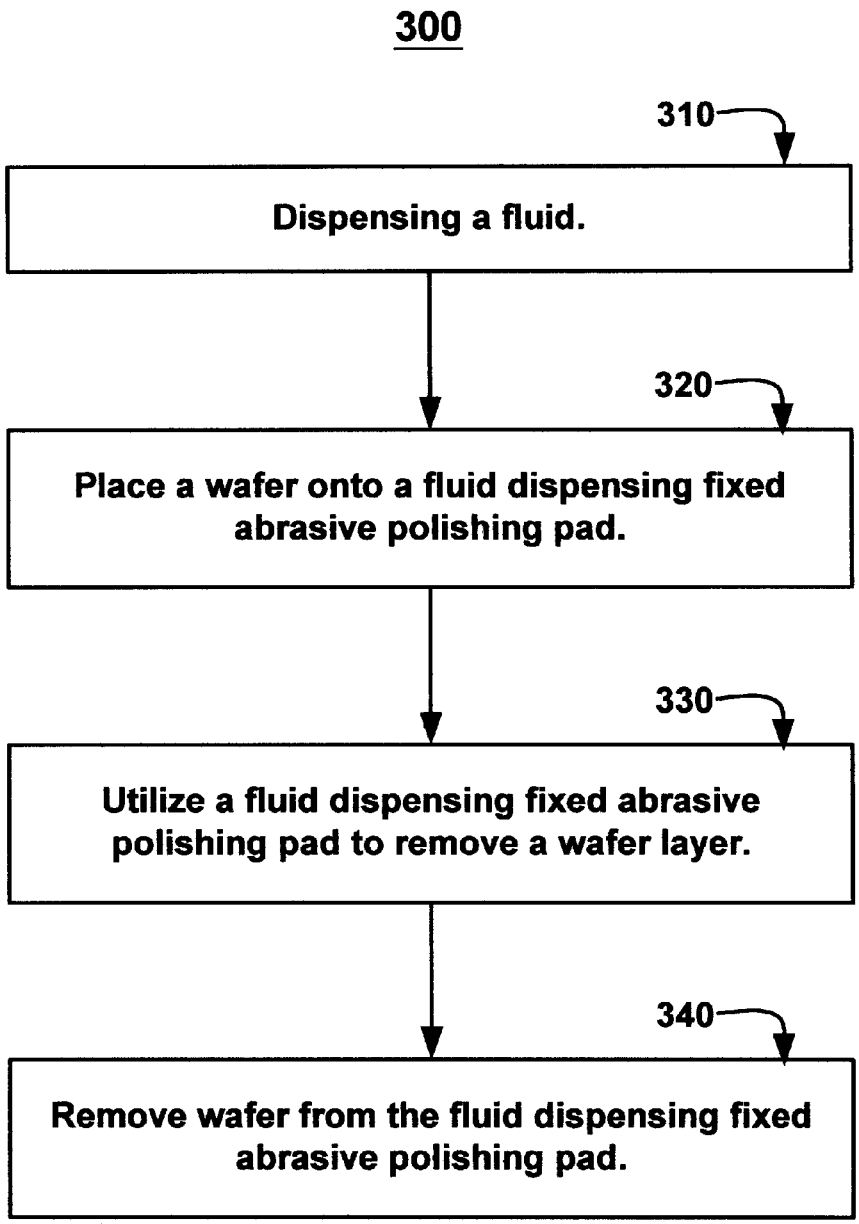
FIG. 3 is a flow chart of the steps of a fluid dispensing fixed abrasive polishing pad method in accordance with one embodiment of the present invention.

FIG. 3 is a flow chart of the steps of a fluid dispensing fixed abrasive polishing pad method 300 in accordance with one embodiment of the present invention. Fluid dispensing fixed abrasive polishing pad method 300 utilizes fixed abrasives to planarize a wafer while applying fluids without abrasive particles. The method of the present invention assists a CMP process to achieve efficient wafer planarization by facilitating fixed abrasive polishing and waste particle removal. Fluid dispensing fixed abrasive polishing pad method 300 of the present invention permits reduced manufacturing times and slurry consumption during IC wafer fabrication.

In step 310 fluid is dispensed. In one embodiment of the present invention, the fluid is dispensed by a fluid dispensing fixed abrasive polishing pad. For example, a fluid dispensing fixed abrasive polishing pad dispenses fluid through fluid dispensing ducts (e.g., fluid dispensing duct 125). The fluid dispensed in step 310 assists the fixed components achieve wafer planarization in numerous ways. The liquid flow in the present invention is adjusted to minimize the scratching of the wafer surface by the fixed abrasive components. In one embodiment of fluid dispensing fixed abrasive polishing pad method 300 the fluid is very efficiently dispensed directly through the fluid dispensing fixed abrasive polishing pad directly onto the surface of the wafer. The fluid dispensed in step 310 does not consist of abrasive slurry particles thereby avoiding detrimental side affect associated with abrasive slurry particles. Furthermore, fluids dispensed though the ducts of fluid dispensing fixed abrasive polishing pad 100 aid in the removal of particulate contaminants. For example, the dispensed fluid forces waste particles (e.g., reaction products, wafer shavings, particulate contaminants, etc.) out of the grooves, pits and fluid dispensing ducts of the fluid dispensing fixed abrasive polishing pad.

The present invention is capable of dispensing a variety of fluids and is adaptable to numerous situations. In one embodiment a fluid comprising a chemical (e.g., base or acid) is gradually introduced to the surface of the fluid dispensing fixed abrasive polishing pad electrostatically prevents particulate waste from bonding to the wafer surface and forming defects. Furthermore, the present invention permits continuous alteration of the chemical composition of the fluid in addition to simple on-off control of certain fluids to the surface of the fluid dispensing fixed abrasive polishing pad.

In step 320 a wafer is placed onto a fluid dispensing fixed abrasive polishing pad of a CMP system. In one embodiment of fluid dispensing fixed abrasive polishing pad method 300, a wafer (e.g., wafer 224) is placed onto a fluid dispensing fixed abrasive polishing pad by a wafer holder (e.g., wafer holder 220). The wafer holder rotates the wafer while asserting a downward pressure on the wafer forcing it onto the surface of the fluid dispensing fixed abrasive polishing pad.

In step 330, a fluid dispensing fixed abrasive polishing pad is utilized to remove a portion or entire layer of a wafer. The fluid dispensing fixed abrasive polishing pad rotates at a predetermined speed and is made of a resilient material with fixed abrasive components. In one embodiment of step 330, fixed abrasive components (e.g., embedded abrasive particles) of the fluid dispensing fixed abrasive polishing pad remove a portion or entire layer of a wafer by exerting frictional force against the wafer surface. In one embodiment, fluid dispensing fixed abrasive polishing pad removes the surface of the wafer without assistance from abrasive particles in a slurry. As fluid dispensing fixed abrasive polishing pad method 300 continues, dielectric material is continually removed from the surface of the wafer, thereby achieving the desired planarity.

In step 340, the wafer is removed from the fluid dispensing fixed abrasive polishing pad when the wafer has been fully planarized. In one embodiment of fluid dispensing fixed abrasive polishing pad method 300, a CMP machine subsequently sends the wafer (now in a polished condition) forward in the fabrication line for the next step in processing and prepares for a next wafer from a queue.

In one embodiment of fluid dispensing fixed abrasive polishing pad method 300 there is another step in which fluid and waste particles are suctioned back through the fluid dispensing fixed abrasive polishing pad. In one embodiment of the present invention, the fluid dispensing ducts dispense fluid during certain intervals and collect polishing by-products at other desired intervals. For example, fluid is first dispensed onto the surface of a fluid dispensing fixed abrasive polishing pad and then after waste particles become suspended in the fluid it is vacuumed back through the fluid dispensing ducts. In one embodiment of the present invention a higher pH fluid or surfactant is introduced to assist in removing the waste particles.

Thus, a fluid dispensing fixed abrasive polishing pad system and method of the present invention facilitates an efficient and effective manner to polish the surface of an IC wafer. The system and method does not require free floating abrasive particles and does not incur detrimental side affects caused by abrasive slurry particles, such as uneven layer removal due to agglomeration of the abrasive slurry particles, abrasive slurry particulate contamination deposited on the wafer surface, spent abrasive particles lodging in the grooves and pits of the polishing pad, etc. The system and method also facilitates uniform distribution of fluid to the center of a wafer surface, thereby avoiding uneven polishing of wafer edges compared to the center of a wafer surface. It also aids conditioning processes to prepare a pad for continued use. The system and method facilitates defect reduction (e.g., lower defect density) and cleaner CMP processes that improve reliability of integrated circuit manufacturing. CMP process utilizing the present invention are cleaner than processes that rely on slurries comprising abrasive particles because there are no spent abrasive particles to contaminate the wafer surface. The ability to keep a cleaner CMP tool increases the availability of the tool to process wafers, resulting in lower costs per wafer due to less preventative maintenance.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order best to explain the principles of the invention and its practical application, thereby to enable others skilled in the art best to utilize the invention and various embodiments with various modifications as are suited to the particular use contemplated. It is intended that the scope of the invention be defined by the Claims appended hereto and their equivalents.

What is claimed is:

1. A fluid dispensing fixed abrasive polishing pad comprising:

a polishing pad body with a lower surface and upper surface substantially parallel to a plane defined by a diameter and opposite one another with both said lower surface and said upper surface having a fluid dispensing duct, said fluid dispensing duct adapted to permit forced fluid to flow from a surface of said polishing pad body to a wafer, wherein said polishing pad body permits said fluids to flow at a force sufficient to remove waste from the surface of a wafer and said polishing pad body during a polishing process, including permitting a flow sufficient to force contaminant waste particles out of said fluid dispensing ducts; and a fixed abrasive component coupled to said polishing pad body, said fixed abrasive component adapted to remove a portion of said wafer when rubbed against a surface of said wafer, wherein said fixed abrasive components do not require assistance from abrasive particles in an abrasive slurry and wherein said abrasive component further comprises abrasive particles coupled to said upper and lower surface of said polishing pad body in a uniform and densely distributed manner over said upper and lower surface, and said flow of said fluid is sufficient to force contaminant waste particles out of a space around said fixed abrasive component.

2. The fluid dispensing fixed abrasive polishing pad of claim 1 wherein a fluid comprising a chemical is gradually introduced to said upper surface.

3. The fluid dispensing fixed abrasive polishing pad of claim 1 wherein the fluid flow is strong enough to remove waste from a surface of a wafer and said fixed abrasive polishing pad during a polishing process.

* * * * *